United States Patent [19]

van Laar

[11] 3,953,007

[45] Apr. 27, 1976

[54] WALL CONSTRUCTION OF A SHAFT FURNACE

[75] Inventor: Jacobus van Laar, Santpoort, Netherlands

[73] Assignee: Hoogovens Ijmuiden B.V., Ijmuiden, Netherlands

[22] Filed: Sept. 6, 1974

[21] Appl. No.: 503,658

[30] Foreign Application Priority Data

Sept. 12, 1973 Netherlands ..... 7312549

[52] U.S. Cl. ..... 266/193; 266/280

[51] Int. Cl.[2] ..... C21B 7/10

[58] Field of Search ..... 266/32, 43; 110/6 B

[56] References Cited

UNITED STATES PATENTS

| | | | |
|---|---|---|---|
| 1,014,314 | 1/1912 | Marshall | 266/32 |
| 3,652,070 | 3/1972 | Sagara | 266/32 |
| 3,682,457 | 8/1972 | Hollingworth | 266/25 |

*Primary Examiner*—Gerald A. Dost

*Attorney, Agent, or Firm*—Stevens, Davis, Miller & Mosher

[57] ABSTRACT

A shaft furnace having a refractory-lined wall at least part of which is provided with liquid-cooled cooling plates which extend into the lining and are grouped in a plurality of horizontal planes. The cooling plates in each plane are in heattransfer contact with an associated ring extending around the furnace which consists of refractory material of a first kind having a heat conductivity coefficient (λ) at 20°C. of at least 25 kilocalories/hour.meter.°C. The interior face of the lining also is provided at least partly by refractory material of a second kind which has high resistance to wear and chemical attack and has a minimum reaction temperature (Tu) of at least 600°C. and a heat conductivity coefficient (λ) at 20°C. of at least 8 kilocalories/hour.meter.°C.

10 Claims, 1 Drawing Figure

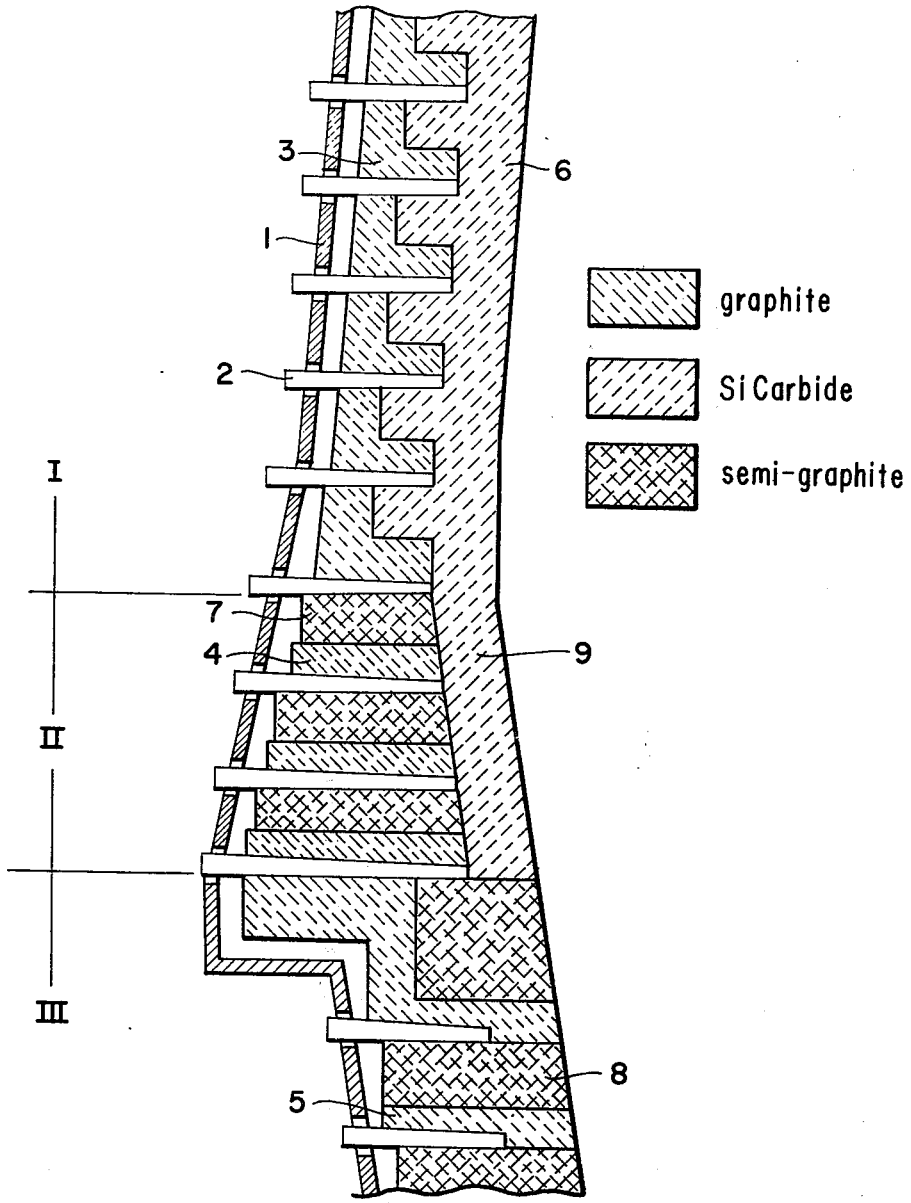
3
6
1
2
I
7
4
9
II
III
8
5
graphite
Si Carbide
semi-graphite

WALL CONSTRUCTION OF A SHAFT FURNACE

The invention relates to a shaft furnace, especially a blast furnace and more particularly a shaft furnace having a refractory-lined wall at least part of which is provided with liquid-cooled cooling plates which extend into the lining and are grouped in a plurality of horizontal planes, the cooling plates in each said plane being in heat-transfer contact with an associated ring extending around the furnace and consisting of refractory material of a first kind having a heat conductivity coefficient ($\lambda$) at 20°C of at least 25 kcal/h.m. °C, (kilocalories/hour-meter-°centigrade) and the interior face of the lining being provided at least partly by refractory material of a second kind.

In modern, high duty blast furnaces, it is found that in the operating cycle of the furnace, the time period between two successive repairs is determined to a considerable degree by wearing properties of the furnace lining, which in turn are dependent upon a large number of factors, such as durability against high temperature, chemical attack and mechanical wear, and also the mode of cooling the furnace. While modern furnaces are being pushed to ever higher duties, various attempts have been made in various directions to keep the life-time of the refractory lining sufficiently long. For that purpose various new cooling systems have been developed apart from the traditional cooling plates, such as stave-coolers and evaporation cooling. With such constructions, however, the stability of the lining in the furnace shaft becomes a greater problem than with cooling plates.

In German Auslegeschrift No. 2.050.443 it is proposed to improve the durability of the lining in the furnace shaft by inter alia the selection of a specific lining material. The selected lining consists over its entire cross-section of the same material, and a special requirement is set for the following two properties of the material:

$\lambda$ = heat conductivity coefficient at 400°C in kcal/m.h°C.

Tu = minimum reaction temperature in °C, i.e. the upper limit of temperature at which the material in production conditions is not chemically attacked.

The special requirement consists in that the product $\lambda \times$ Tu does not exceed 4000 kcal/m.h. However, it has been found that in satisfying this requirement in itself, no solution has yet been obtained of the problem of mechanical wear of the lining resulting from the movement of the furnace burden relative to the lining.

Furthermore when setting this combined requirement for a uniform lining material, in combination with cooling of the wall by means of stave-coolers, a restriction of in choice to expensive constructions must be accepted.

It has been attempted to improve considerably the cooling of a blast furnace with the aid of traditional cooling with cooling plates by assembling the cooling plates within circular rings made of semi-graphite. Because of the larger cooling surface of the semi-graphite rings, which have an improved heat conductivity, it was expected that a chamotte lining positioned in front of these rings would remain sufficiently cool to withstand further attack from within the furnace. It is found however, that nevertheless the chamotte still wears away with the eventual result that only the semi-graphite rings remain. After the disappearance of support for these rings, they collapse because of the mechanical pressure from the burden.

According to the invention there is provided a shaft furnace having a refractory-lined wall at least part of which is provided with liquid-cooled cooling plates which extend into the lining and are grouped in a plurality of horizontal planes, the cooling plates in each said plane being in heat-transfer with an associated ring extending around the furnace and consisting of refractory material of a first kind having a heat conductivity coefficient ($\lambda$) at 20°C of at least 25 kcal/h.m.°C, and the interior face of the lining being provided at least partly by refractory material of a second kind which has high resistance to wear and chemical attack and has a minimum reaction temperature (Tu) of at least 600°C and a heat conductivity coefficient ($\lambda$) at 20°C of at least 8 kcal/h.m.°C.

Where high wear resistance especially is required, as for instance in the shaft zone of a blast furnace, it is preferable that the interior face of the lining is provided by a continuous inner layer of refractory material of the second kind. Preferably also, the rings can be united to for a continuous outer layer. Excellent coherence of the lining can be achieved in this case if mutually abutting faces of the said rings on the one hand and the said inner layer on the other hand have complementary projections and recesses so as to provide an anchoring effect of the inner layer in the rings.

At other zones, the refractory material of the second kind can be vertically separated layers between the rings, which extend to the interior face.

One or more refractory materials meeting the requirements of either the first or the second kind of material may be present. Some materials, e.g. semi-graphite fulfill the requirement set for both kinds.

In a furnace of the invention, the rings of good thermally conductive material do not just mainly cool their boundary surface with material providing the inner face; but because of the choice for the latter material of a higher $\lambda$-value than that of the usual chamotte and corundum materials, the temperature of the entire lining can be kept at a lower value. This when combined with increased resistance to chemical and mechanical attack can give the lining a hitherto unknown durability and a long life time, even under extremely heavy thermal load in a blast furnace.

As greater axial symmetry of the pattern of heat transfer from within the furnace is obtained by using rings of refractory material than just by using cooling plates extending into a single lining, under normal conditions of use no especially high requirements need to be set for the thermal contact between adjacent bricks in the peripheral direction within the rings. It even is feasible intentially to provide expansion joints at various places which then may be filled with a good conductive and compressible refractory ramming mass.

The contact surface between each cooling plate and the associated ring should be sufficiently great to guarantee good heat transfer to the cooling plates. Often therefore, the side-surfaces of the cooling plates will be in contact with the material of the ring, though it is also feasible that the cooling plates also, or only, make contact with the upper and/or lower surface of the ring.

Connection of the rings to form a coherent outer layer improves the surface cooling on this intensely thermally loaded spot further. If between the furnace shell and the outer layer there is an insulating ramming mass, almost all heat transferred through the wall is conveyed by the better conducting outer layer to the cooling plates. This offers the advantage that the furnace shell remains relatively cool and does not need separate cooling by for instance spray cooling.

As mentioned above it is also possible and within the scope of the invention, to achieve good results if the interior surface or front layer consists of vertically separate layers which fill open spaces between the rings. The smaller resistance to wear of the material of the rings is in this arrangement compensated by the higher resistance to wear of the alternating layers in between.

It will be clear that best results can be obtained with a material for the rings with a much higher λ-value, in combination with a material of the second kind which has a resistance both to mechanical and chemical wear which is as great as possible and a λ-value which is relatively high in comparison with chamotte. In the shaft of a blast furnace therefore optimum results have been obtained when the rings consist of graphite and the interior face is provided by a continuous inner layer of SiC blocks.

It is remarked that SiC as a consequence of its high λ-value in comparison with chamotte, and because of its great strength and low expansion rate shows a high spalling resistance. For that reason this material is exceptionally suited for use at locations which experience great changes in temperature, such as the lower shaft.

Below the level of the shaft of a blast furnace the fraction of the solid material in the burden diminishes by reason of the melting of iron and slag. At this region other requirements therefore are to be met by the lining. Especially it has been found that in the bosh, where less mechanical wear is to be expected, good results can be obtained if the material of the second kind is in separate layers between the rings, which layers consist of bricks of semi-graphite, and the circular rings consist of bricks of graphite. Preferably the graphite is immediately above and in between the cooling plates, and the semi-graphite immediately underneath the cooling plates.

Though in the zone below the shaft mechanical wear diminishes by reason of the gradual melting of material, this wear cannot be completely neglected, especially in the upper part of the bosh and the transition zone from shaft to bosh. Best results have therefore been obtained for this zone with a lining in which the interior face is a continuous inner layer of SiC and the rings consist of graphite bricks immediately above, and semi-graphite bricks immediately below, the cooling plates.

It will be clear that the cooling pattern in the lining very much depends on the nature of the lining and on the positioning of the cooling plates. In a blast furnace embodying the invention, best results were found obtainable if the vertical pitch of the pattern of cooling plates, i.e. the vertical spacing of neighbouring groups of cooling plates, is less than 60% of the width of the lining at the region in question. Though viewed over the height of the lining the relative width of the front or inner layer and the back or outer layer, consisting of different materials, may vary, it appears that by so selecting the pitch of the cooling plate pattern, the paths of the isotherms through the lining during operation of the furnace deviate only little from linear, which means that the wear of the lining advances very slowly, and especially regularly.

One embodiment of the invention will now be described by way of example with reference to the accompanying drawing, in which the single FIGURE shows part of the wall of a blast furnace in longitudinal section. The parts shown comprise the lower part of a blast furnace shaft, the upper end of the bosh and the transition zone between shaft and bosh.

The blast furnace embodying the invention has a steel shell 1, enclosing a refractory lining. In apertures in this shell 1 a great number of cooling plates 2 of known design are provided, these cooling plates extending into the furnace lining, and being connected in use to a supply system for cooling fluid. The cooling plates 2 are grouped in horizontal circles, which are equally spaced over the height of the furnace, with a single exception for constructional reasons.

The lining consists of three different materials i.e. graphite, SiC and semi-graphite which in the FIGURE have been distinguished, as shown in the key, by left-hatching, right-hatching and cross-hatching respectively.

All the cooling plates shown are in engagement at their upper and/or lower faces, with layers of graphite bricks, which in the various zones of the lining are indicated by reference numerals 3 4 and 5. The graphite blocks around each of the groups of cooling plates in one horizontal plane, form part of a closed circular ring of graphite blocks inside the lining. The result is that all the cooling plates in one horizontal plane are extended to closed circular cooling rings, as heat conduction through graphite and heat transfer from graphite to the cooling plates are relatively great.

In the various zones, i.e. the shaft, the transition zone and the bosh, these zones being indicated in the FIGURE by I, II and III respectively, the closed rings are incorporated in the rest of the lining in different ways. In the shaft zone I the closed rings, constituted by layers 3, are mutually connected vertically to form a continuous graphite outer layer containing the cooling plates 2, which provides very intensive cooling of the rest of the lining. The remainder of the lining is constituted by an inner layer 6 of SiC bricks, in which short bricks alternate with long bricks. The graphite layer is shaped complementarily. Because of this alternation of short and long bricks a boundary surface of crenelated shape is formed, which achieves a good anchoring of the inner layer of SiC in the cooled layer of graphite. Because of the high values of the minimum reaction temperature Tu of silicon carbide, which can amount to above 600°C, in combination with its known superior resistance to wear there is obtained in this way an inner layer which both chemically and mechanically is very resistant to the effect of the furnace burden moving along it.

Only however, because of the good anchoring of this wear resistant layer in the outer layer which itself can provide very uniform and intensive cooling, is the optimum effect of this construction achieved.

In the bosh zone III, where the abrasive action of the burden is less intensive, the SiC is replaced by semi-graphite blocks 8, and the graphite rings 5 extend until in front of the cooling plates to the interior face of the lining. Because semi-graphite has better heat conductive properties than SiC, it is not necessary in this zone to interconnect the closed circular rings of graphite bricks, so that these rings can be completely separated by big bricks of semi-graphite.

In the transition zone II between the shaft and the bosh an intermediate construction is employed, in which the closed rings of graphite blocks 4 also are completely separated by semi-graphite layers 7, but in which an inner layer 9 of SiC bricks is provided at the interior face. This layer 9 need not be anchored into the outer layer, as is necessary in the shaft, as the lining construction in the bosh and in the transition zone is self-supporting.

What we claim is:

1. A shaft furnace having a refractory-lined wall at least part of which is provided with liquid-cooled cooling plates which extend into the lining and are grouped in a plurality of horizontal planes, the cooling plates in each said plane being in heat-transfer contact with an associated ring extending around the furnace and consisting of refractory material of a first kind having a heat conductivity coefficient ($\lambda$) at 20°C of at least 25 kcal/h.m.°C, and the interior face of the lining being provided at least partly by refractory material of a second kind which has high resistance to wear and chemical attack and has a minimum reaction temperature (Tu) of at least 600°C and a heat conductivity coefficient ($\lambda$) at 20°C of at least 8 kcal/h.m.°C.

2. A shaft furnace according to claim 1 wherein over at least part of its height the interior face of the lining is provided by a continuous inner layer of refractory material of the second kind.

3. A shaft furnace according to claim 2 wherein mutually abutting faces of the said rings on the one hand and the said inner layer on the other hand have complementary projections and recesses so as to provide an anchoring effect of the inner layer in the rings.

4. A shaft furnace according to claim 1. wherein the said refractory material of the second kind is, over at least part of the height of the wall in vertically separated layers between said rings, which extend to the interior face.

5. A shaft furnace according to claim 1 in the form of a blast furnace.

6. A shaft furnace according to claim 5 wherein in the shaft of the blast furnace the said rings consist of graphite and at the interior face there is a continuous inner layer of SiC bricks.

7. A shaft furnace according to claim 6 wherein in the transition zone of the blast furnace from shaft to bosh there is a continuous inner layer of SiC at the interior face and the rings consist of graphite bricks immediately above, and semi-graphite bricks immediately below, the cooling plates.

8. A shaft furnace according to claim 7 wherein in the bosh of the blast furnace the interior face of the lining partly consists of semi-graphite bricks, and the rings consist of graphite bricks, the semi-graphite bricks being in vertically separated layers between the rings.

9. A shaft furnace according to claim 8 wherein in the bosh the semi-graphite bricks are immediately above the cooling plates and the graphite bricks immediately below.

10. A shaft furnace according to claim 1 wherein the vertical spacing of neighbouring groups of cooling plates is not more than 60% of the local width of the refractory lining.

* * * * *